US006801371B1

(12) United States Patent
Liu

(10) Patent No.: US 6,801,371 B1
(45) Date of Patent: Oct. 5, 2004

(54) DRESSING MIRROR WITH MULTIPLE FUNCTIONS

(75) Inventor: Tsai-Jung Liu, Taipei Hsien (TW)

(73) Assignee: Homecosy, Inc., Taipei Hsien (TW)

( * ) Notice: Subject to any disclaimer, the term of this patent is extended or adjusted under 35 U.S.C. 154(b) by 0 days.

(21) Appl. No.: 10/394,519

(22) Filed: Mar. 24, 2003

(51) Int. Cl.[7] ..... G02B 17/00; G02B 7/182; A45D 42/00

(52) U.S. Cl. ..... 359/726; 359/732; 359/871; 132/316

(58) Field of Search ..... 359/726, 727, 359/732, 802, 803, 871, 872, 808, 838, 879; 132/291, 296, 301, 304, 316

(56) References Cited

U.S. PATENT DOCUMENTS 1,347,593 A * 7/1920 Rugh
1,525,665 A * 2/1925 Slover et al.
3,006,252 A * 10/1961 Kacowski
3,527,524 A * 9/1970 Pace et al.
3,632,191 A * 1/1972 Cox
3,677,620 A * 7/1972 Bettencourt
3,949,767 A * 4/1976 Rose
3,996,947 A * 12/1976 Szpur et al.
5,442,488 A * 8/1995 Pastorino
5,950,640 A * 9/1999 Duncan et al.
6,441,969 B1 * 8/2002 Goldstein et al.

FOREIGN PATENT DOCUMENTS

JP 2002-360339 * 12/2002

* cited by examiner

*Primary Examiner*—Ricky D. Shafer
(74) *Attorney, Agent, or Firm*—Harrison & Egbert

(57) ABSTRACT

The present invention of a multi-functional dressing mirror is applied to a portable case body for containing a plane mirror inside, in addition, the outer covering, a convex mirror made from materials showing the effect of light transmission, can be used to magnify a user's reflection while s/he is staring at the plane mirror. Moreover, the present invention enables the user to directly use either the plane mirror or the convex mirror while the case lid is opened.

1 Claim, 4 Drawing Sheets

DRESSING MIRROR WITH MULTIPLE FUNCTIONS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a multi-functional dressing mirror, more especially to a dressing mirror having an outer covering design thereof by materials with the effect of light transmission, furthermore, a lid of the outer covering is set to be an arc surface with the effect of magnification. Therefore, the tie-in usages of the outer covering and a plane mirror set inside the dressing mirror enable a user to enlarge either his/her figure or any object on the opposite side against the outer covering or to reflect him/her in the inner plane mirror thereof.

BACKGROUND OF THE INVENTION

A dressing mirror is a necessary accessory in a lady's dressing box for sprucing herself, such as wearing fake eyelashes, contact lens, or eye liner, lining up eyebrows and putting powder on the skin, etc. A commonly used dressing mirror is usually a plane mirror to be fixed inside a dressing compact. In view of that some dress up movements of wearing contact lens and fake eyelashes require careful preparations, as well as presently known portable dressing mirrors are all small and light-weighted, the present invention of a multi-functional dressing mirror is designed to meet that requirement.

BRIEF SUMMARY OF THE INVENTION

In view of the foregoing, the primary objective of the present invention aims at providing a multi-functional dressing mirror designed to set a convex mirror on the upper covering body thereof with the function of light transmission, so as to heighten the usages of a dressing mirror by means of the combination of a convex mirror and an inner plane mirror thereof.

To enable a further understanding of the structural features and the technical contents of the present invention, the brief description of the drawings below is followed by the detailed description of the preferred embodiment.

DETAILED DESCRIPTION OF THE INVENTION

Figure 1:
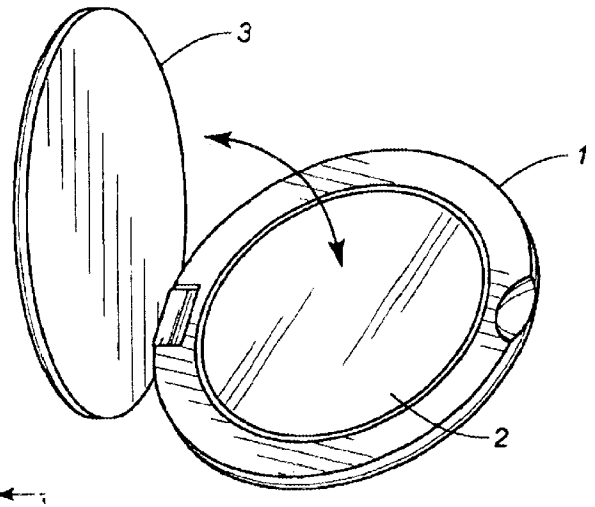
FIG. 1 is a perspective drawing showing the use of the present invention.
Figure 2:
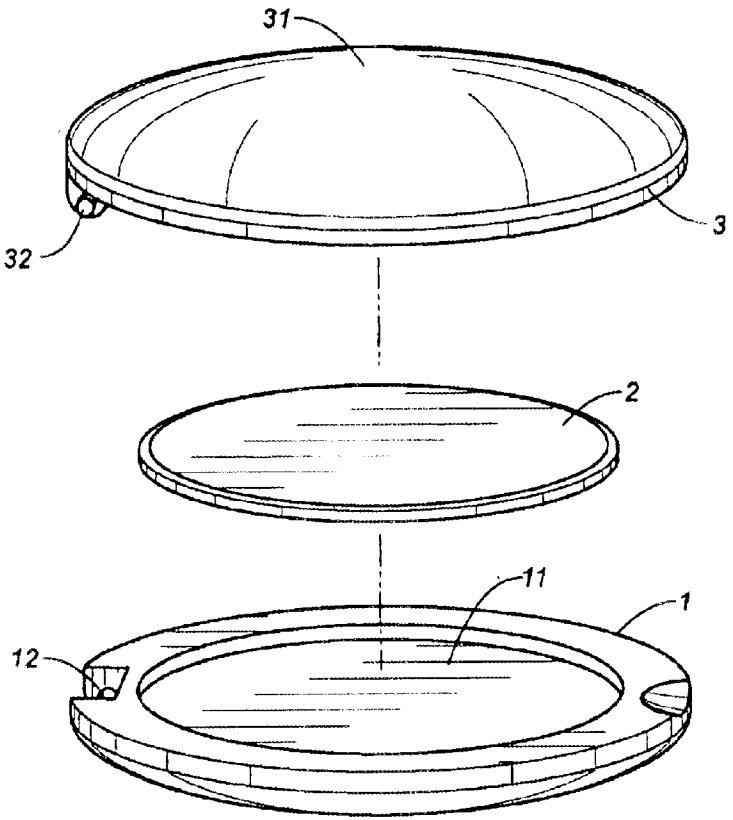
FIG. 2 is a perspective exploded view of the present invention.

FIG. 1 shows the present invention of a multi-functional dressing mirror mainly comprises an opened lid (3) and a dressing mirror case body (1) wherein a plane mirror (2) is inlaid for a user to reflect himself/herself while the user is staring at the plane mirror. As is shown in FIG. 2 that the structure of the dressing mirror case body (1) is a clumpy-shaped object, inside which a mirror recess (11) is set in the center with equal size of the plane mirror (2). At one rim of the dressing mirror case body (1) sets a dint, which horizontally allows a pair of pivots to be installed. The plane mirror (2) is a plate-shaped object and the surface thereof has the capability of reflecting an object of the opposite side. The lid (3) is an arc-shaped convexity made from materials showing the light transmission effect with thicker body in the center and thinner rim to form a convex mirror (31). Corresponding to the dint of the dressing mirror case body (1), at the rim of the lid (3) there sets a downward convexity, which sets a pair of protrudent shafts (32) at both left and right sides thereof, respectively. The shafts (32) are installed in the pivots (12) of the dressing mirror case body (1) to enable the lid to be opened and placed on the dressing mirror case body (1).

Figure 3:
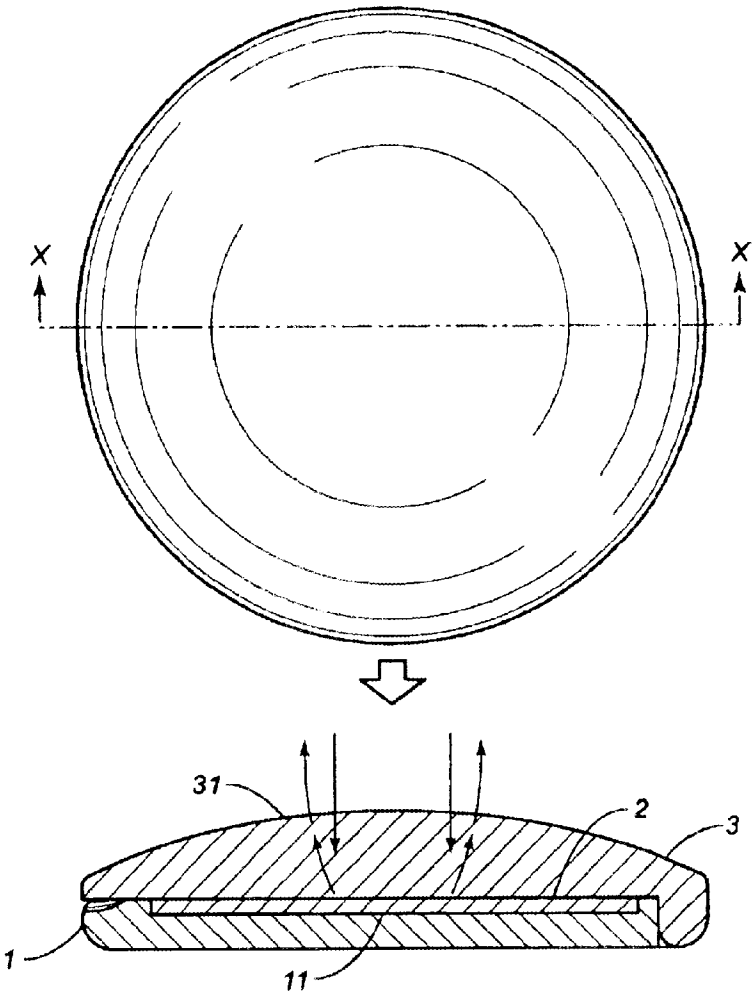
FIG. 3 is a cross-sectional drawing by an overlook and a side view showing the use of the present invention.

FIG. 3 shows the close status of the dressing mirror of the present invention, as indicated, the plane mirror (2) is entirely embedded in the mirror recess (11) of the dressing mirror case body (1), where the lid (3) is flat placed on the dressing mirror case body (1), i.e., the plane mirror (2) is covered with the lid (3). A user can directly reflect himself/herself in the mirror to magnify his/her own figure by staring at the plane mirror (2) by dint of the convex mirror (31) of the lid (3) (in the direction as the arrowheads indicated on the drawing).

Figure 4:
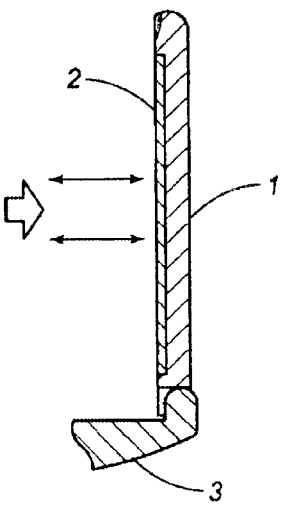
FIG. 4 a cross-sectional drawing showing a second preferred embodiment of the present invention.

As shown on FIG. 4, a user can directly look at himself/herself in the plane mirror after opening the lid (3) (as indicated by the arrows).

Figure 5:
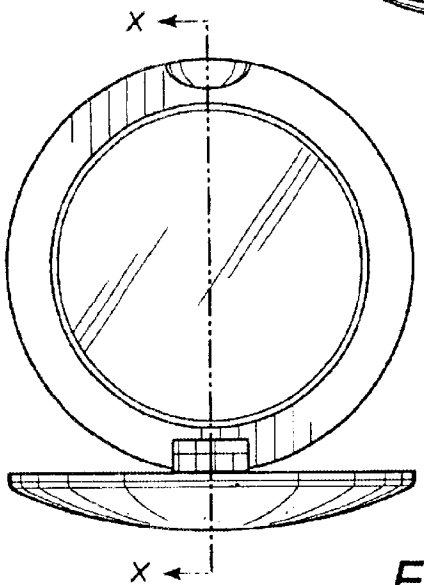
FIG. 5 is a side view showing a third preferred embodiment of the present invention.
Figure 5:
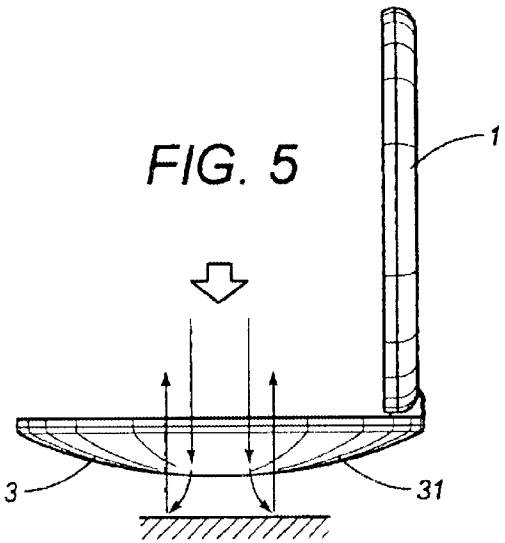

In addition, as shown on FIG. 5 that the convex mirror (31) of the lid (3) can be independently used for reading newspapers and books or as a magnifier for searching little tiny objects, after the lid is opened.

Figure 6:
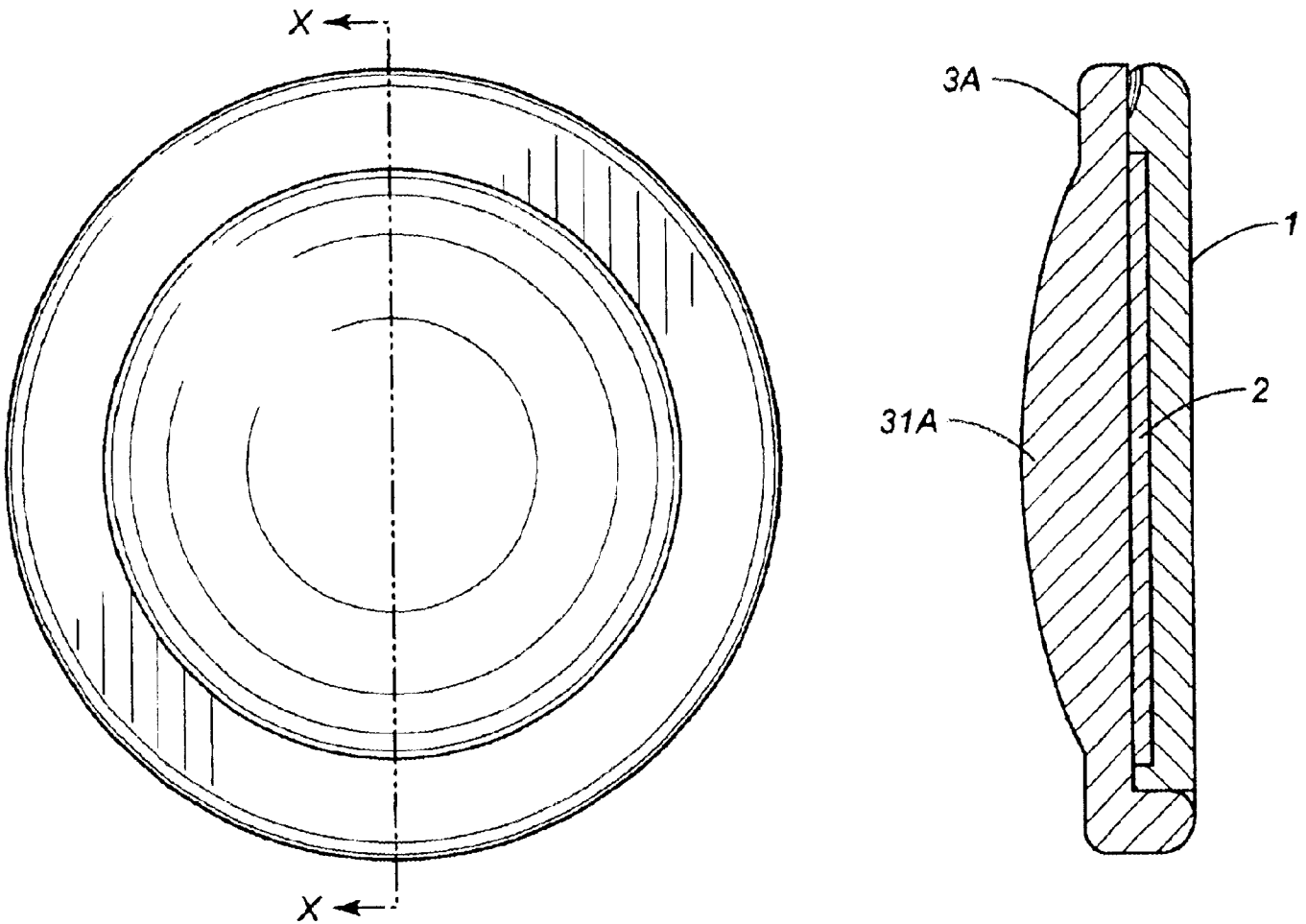
FIG. 6 is the cross-sectional drawing by an overlook and a side view showing the other exemplary embodiment of the present invention.

Nevertheless, the aforementioned convex mirror setup methods can be diversified. As shown on FIG. 6 that the convex mirror (31A) can be partially set on the lid (3A) to overlap the part of the plane mirror (2); in addition, the convex mirror part can be separated and embedded on the lid, in the case, the lid shall be made by non-see through materials without showing the effect of light transmission (the embodiment is not disclosed on the drawings).

Figure 7:
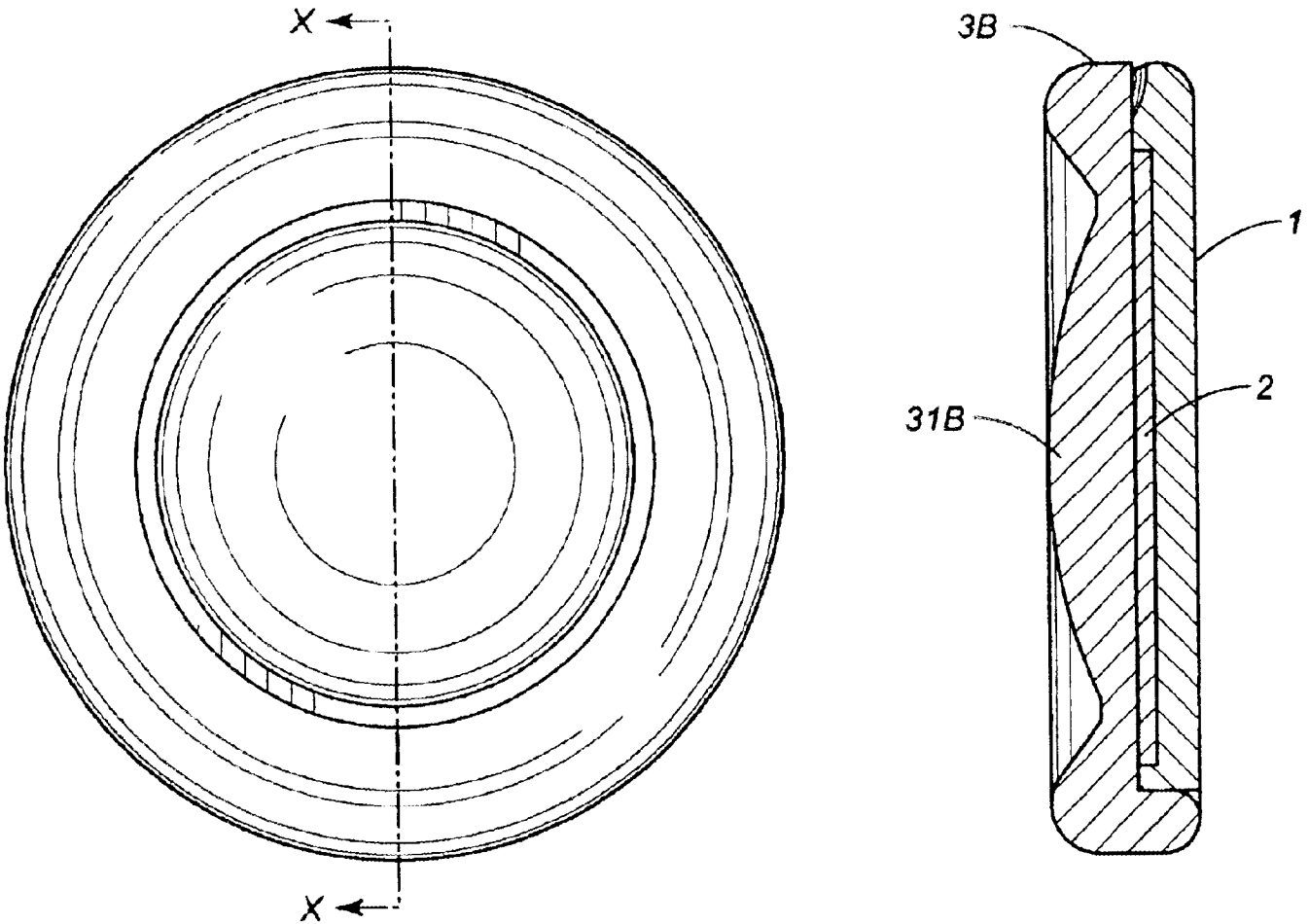
FIG. 7 is the cross-sectional drawing by an overlook and a side view showing another exemplary embodiment of the present invention.

Another embodiment as shown on FIG. 7 that the convex mirror (31B) of the lid (3B) is set in a recess area to enable the surface of the convex mirror to be lower than the lid (3B), so that the convex mirror can be appropriately protected.

Moreover, the multi-functional dressing mirror of the present invention can be not only carried easily owing to its light-weighted size, but also set as a table dressing mirror by installing bracings on the mirror case body. The variety of offshoots of the present invention, therefore, enables the dressing mirror to make extended applications.

It is of course to be understood that the embodiment described herein is merely illustrative of the principles of the invention and that a wide variety of modifications thereto may be effected by persons skilled in the art without departing from the spirit and scope of the invention as set forth in the following claims.

I claim:

1. A multi-function dressing mirror comprising:

a portable case body having a recess formed centrally in a top surface thereof;

a planar mirror affixed within said recess of said case body such that a top surface of said planar mirror is flush with or slightly below said top surface of said case body; and an outer covering pivotally connected at one side thereof to said case body, said outer covering being of a light transmissive material, said outer covering having a generally planar surface on one side thereof and a generally convex surface on an opposite side thereof, said outer covering movable between a first position in which said generally planar surface of said outer cover overlies said planar mirror and is in surface-to-surface contact with said top surface of said case body and a second position in which said generally planar surface of said top cover is angularly offset from said top surface of said case body.

* * * * *